US008696001B1

(12) United States Patent
Olsauskas

(10) Patent No.: US 8,696,001 B1
(45) Date of Patent: Apr. 15, 2014

(54) SKATEBOARD BINDINGS

(71) Applicant: Linas Petras Olsauskas, Woodbridge, IL (US)

(72) Inventor: Linas Petras Olsauskas, Woodbridge, IL (US)

( * ) Notice: Subject to any disclaimer, the term of this patent is extended or adjusted under 35 U.S.C. 154(b) by 0 days.

(21) Appl. No.: 13/777,605

(22) Filed: Feb. 26, 2013

(51) Int. Cl.
*B60M 1/00* (2006.01)

(52) U.S. Cl.
USPC ..... 280/87.042

(58) Field of Classification Search
USPC ..... 280/809, 807, 87.042, 623, 611, 14.2, 280/811; 441/70, 74, 75
See application file for complete search history.

(56) References Cited

U.S. PATENT DOCUMENTS

| | | | | |
|---|---|---|---|---|
| 4,159,121 | A * | 6/1979 | Spitzke | 280/87.042 |
| 5,544,919 | A * | 8/1996 | Tinkler | 280/809 |
| 6,193,276 | B1 * | 2/2001 | Sottile et al. | 280/816 |
| 2002/0140195 | A1 * | 10/2002 | Lumb | 280/87.042 |
| 2004/0104551 | A1 * | 6/2004 | Jacobs | 280/87.042 |
| 2004/0169351 | A1 * | 9/2004 | Cole, III | 280/623 |

* cited by examiner

*Primary Examiner* — John Walters
*Assistant Examiner* — James Triggs
(74) *Attorney, Agent, or Firm* — Erickson Law Group, PC

(57) ABSTRACT

A binding for a skateboard and a skateboard with bindings are disclosed. The skateboard with bindings have a platform having a longitudinal length and a transverse width; a pair of wheel trucks, spaced apart and attached to a bottom side of the platform; a pair of wheels spaced apart from each other across the transfers width of the platform and attached to each of the wheel trucks, the wheels for supporting the platform on an external surface; and at least one binding comprising engagement portion for receiving direction from a user's foot and a support shaft attaching to the platform, the engagement portion extending above an upper side of the platform.

17 Claims, 5 Drawing Sheets

SKATEBOARD BINDINGS

FIELD OF THE INVENTION

The invention relates to skateboards and more specifically foot bindings for skateboards.

BACKGROUND OF THE INVENTION

Skateboards are known for allowing users to roll along a surface, such as a driveway, supported on a wheeled platform. Skateboards are known to provide transportation and entertainment.

Some skateboard riders engage in stunts or tricks where the rider attempts to do complicated, difficult, or exhibitionist maneuvers. Such tricks may involve using ones feet to cause the skateboard to lift or jump off its support surface. Other tricks involve sliding along or over rails, along edges, along inclines, declines, or obstacles. Some communities and organizations have constructed skateboard parks with various ramps, rails, and other structures which a rider may use to practice or exhibit the rider's skills in performing tricks or otherwise riding on and among the structures in the skateboard park. Organizations have been formed to hold competitions between skateboard riders evaluating the rider's riding skill and ability to perform tricks and exhibitionist maneuvers on and among the aforementioned skateboard park-type-structures.

Performing certain jumps, tricks, and exhibitionist maneuvers requires the rider to be able to shift his or her weight to direct the skateboard to properly engage and land the attempted maneuver. The present inventor has recognized that it would be desirable to provide a device that would assist the rider to more easily be able to direct the skateboard during normal operations and when performing jumps or other maneuvers. The present inventor has recognized that it would be desirable to provide a device that would not unduly interfere with the rider's freedom of movement. The present inventor has recognized that it would be desirable to provide a device that could quickly be engaged and disengaged during skateboard riding without the use of a rider's hands.

SUMMARY OF THE INVENTION

A skateboard with bindings is disclosed. The skateboard comprises a platform having a longitudinal length and a transverse width. The skateboard has a pair of wheel trucks that are spaced apart and attached to a bottom side of the platform. The skateboard has a pair of wheels spaced apart from each other across the transverse width of the platform and attached to each of the wheel trucks. The wheels are for supporting the platform on an external surface. The skateboard has at least one binding comprising engagement portion for receiving direction from a user's foot and a support shaft attaching to the platform. The engagement portion extends above an upper side of the platform.

In some embodiments, the engagement portion is U-shaped.

In some embodiments, the engagement portion comprises a first portion and a second portion and a retaining angle between the first and second portions where the retaining angle is obtuse.

In some embodiments, the engagement portion comprises a hook portion configured to engage the top of a user's foot.

In some embodiments, at least one binding is pivotal about the support shaft connection with the platform.

In some embodiments, the at least one binding comprises two bindings. Each binding is located along the platform adjacent the wheel trucks on a side of the wheel trucks opposite a midpoint of the longitudinal length of the platform. Each binding is positioned for contact with the outside of a user's foot when the user's feet are located above the wheels.

Bindings for a skateboard are also disclosed. The binding for a skateboard has a support shaft for pivotally attaching to a skateboard platform. The binding has an engagement portion for receiving contact with a users foot. The engagement portion is fixed to the support shaft and extends there from. The engagement portion comprises two spaced apart upwardly extending arms. Each arm comprises a first portion and a retaining portion and a first angle between the first portion and the retaining portion. The first angle is an angle other than a straight angle.

Numerous other advantages and features of the present invention will become readily apparent from the following detailed description of the invention and the embodiments thereof, from the claims and from the accompanying drawings.

DETAILED DESCRIPTION

Figure 1:
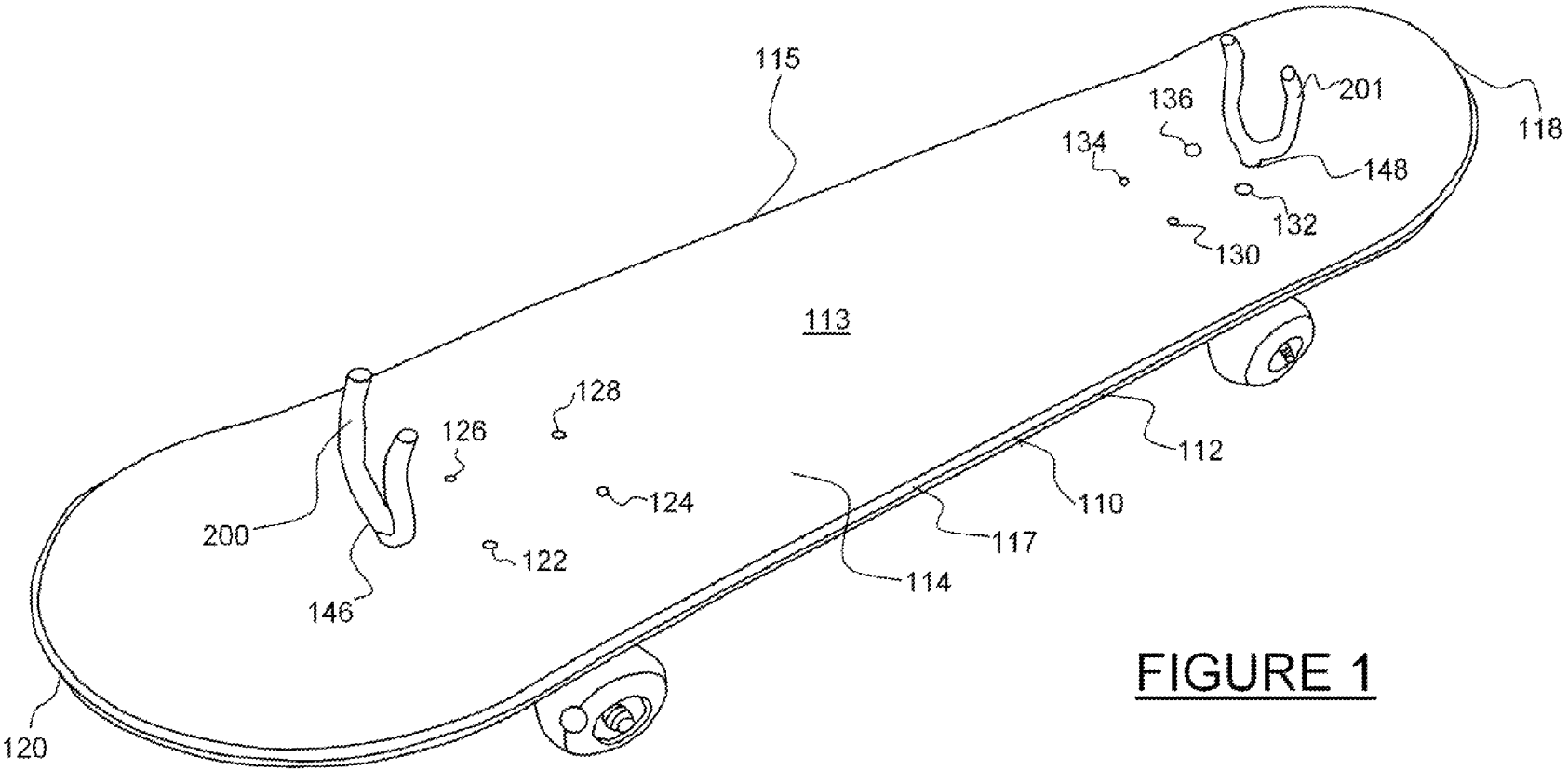
FIG. 1 is a perspective view of a skateboard having an embodiment of a skateboard binding of the invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 shows a skateboard 100 with skateboard bindings 200. The skateboard comprises a platform 110. The platform has a peripheral edge 112, a top surface 114, a bottom surface 116, a first end 118, and an opposite second end 120. The platform has a first longitudinal side 123 and a second longitudinal side 125 divided by a midline 121. A pair of wheel trucks 150,151 are spaced apart and attached to the bottom surface 116 of the board. The wheel trucks each comprise a pair of spaced apart wheels 168, 170. The platform is supported on the wheels via the wheel trucks 150, 151.

In some embodiments, the platform has raised lateral edges 115, 117 and a sunken center surface 113 between the wheel trucks 150, 151. Therefore the top and bottom surfaces between the trucks may have a partially cylindrical or concave shape as shown in FIG. 2.

Figure 2:
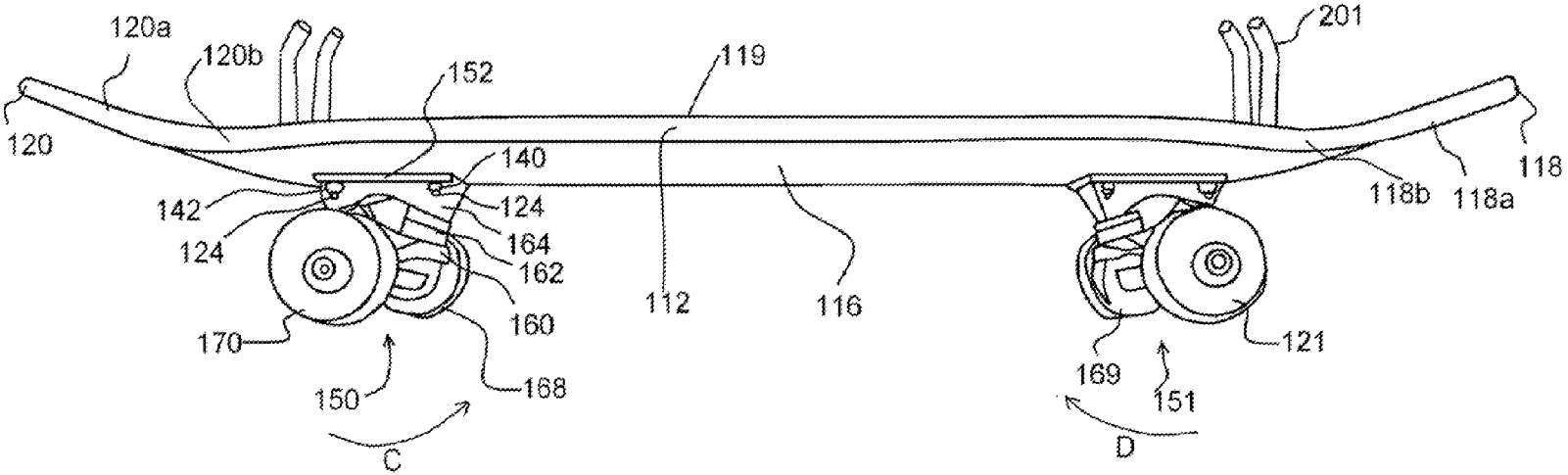
FIG. 2 is a side view of the skateboard taken from FIG. 1.

In some embodiments, the first and second ends are inclined from adjacent wheel trucks opposite the center surface 113 as shown in FIG. 2. The incline at the first end begins at a first angle start point 118*b* adjacent the binding 200 opposite the longitudinal center 119 of the platform and extends along a first inclined section 118*a* to the first end 118. The first inclined section may comprise a curved outer perimeter between the first angle start point 118*b* on a first side to a second angle start point 118*c* on an opposite second side. The incline at the second end begins at a first angle start point 120*b* adjacent the binding 200 opposite the longitudinal center 119 of the platform and extends along a second inclined section 120*a* to the second end 120. The second inclined section may comprise a curved outer perimeter between the angle start point 120*b* on a first side to a second angle start point 120*c* on an opposite second side.

Each wheel truck 150 is attached to the platform with fasteners, such as bolts 122, 124, 126, 128, 130, 132, 134, and 136. The bolts pass through openings in the base 152 and are secured on a side opposite the top surface with nuts 140, 142. The wheel truck comprises the base 152 and an axle 154. The axle has a first cylindrical shaft 156 that is received in a first circular mounting hole 158 of the base 152. A bushing may be provided about the first cylindrical shaft to buffer contact between the shaft and the hole 158. Opposite the shaft 156 is a bushing mount 160 that is provided with a bushing opening 161 that receives the bushing 162. A bolt 166 extends through the bushing, through the bushing opening 161 in the bushing mount 160, and into a receiving hole (not shown) in the rear portion 164 of the base 152. The axle is pivotable about the shaft 165 in the hole 158 as, shown by the arc marked BA in FIG. 4, as constrained by the bushing. The bushing may comprise rubber, polyurethane, or other materials used for bushing known in the art. The wheel trucks allow the skateboard to turn when weight is applied to one side of the skateboard. For example, if more weight is applied to the first longitudinal side 123 than the second longitudinal side 125, then the wheels 171, 170 on the first longitudinal side 123 will pivot upward and inwards as shown by arrows C and D, as shown in FIG. 2. Correspondingly the wheels 168 and 169 will pivot down and outward. As a result, the skateboard will travel toward the direction of the first longitudinal side and away from the direction of the second longitudinal side.

If more weight is applied to the second longitudinal side 125 than the first longitudinal side 123, then the wheels 171, 170 on the first longitudinal side 123 will pivot down and outwards in the directions opposite those shown by arrows C and D. Correspondingly the wheels 168 and 169 will pivot upward and inward. As a result, the skateboard will travel toward the direction of the second longitudinal side and away from the direction of the first longitudinal side. Therefore by shifting one's weight, a skateboard rider can cause the skateboard to turn in either lateral direction. The extent to which the wheel positions pivot depend on the direction and weight of the rider and the compression characteristics of the bushing as the pivoting of the shaft 156 causes the perimeter of the bushing opening 161 to press against the bushing on one side or the other depending on the pivot direction. Therefore, the bushing limits the pivot travel of the axle and the wheels.

Wheel truck 150 is identical to wheel truck 151. Wheel truck 151 is mounted the platform in an orientation that is 180 degrees from the orientation of wheel truck 150 as shown in FIG. 2. Other wheel truck arrangements known in the art may be substituted for wheel trucks 150, 151, such as the wheel trucks disclosed in U.S. Pat. No. 4,214,768, herein incorporated by reference.

Figure 6:
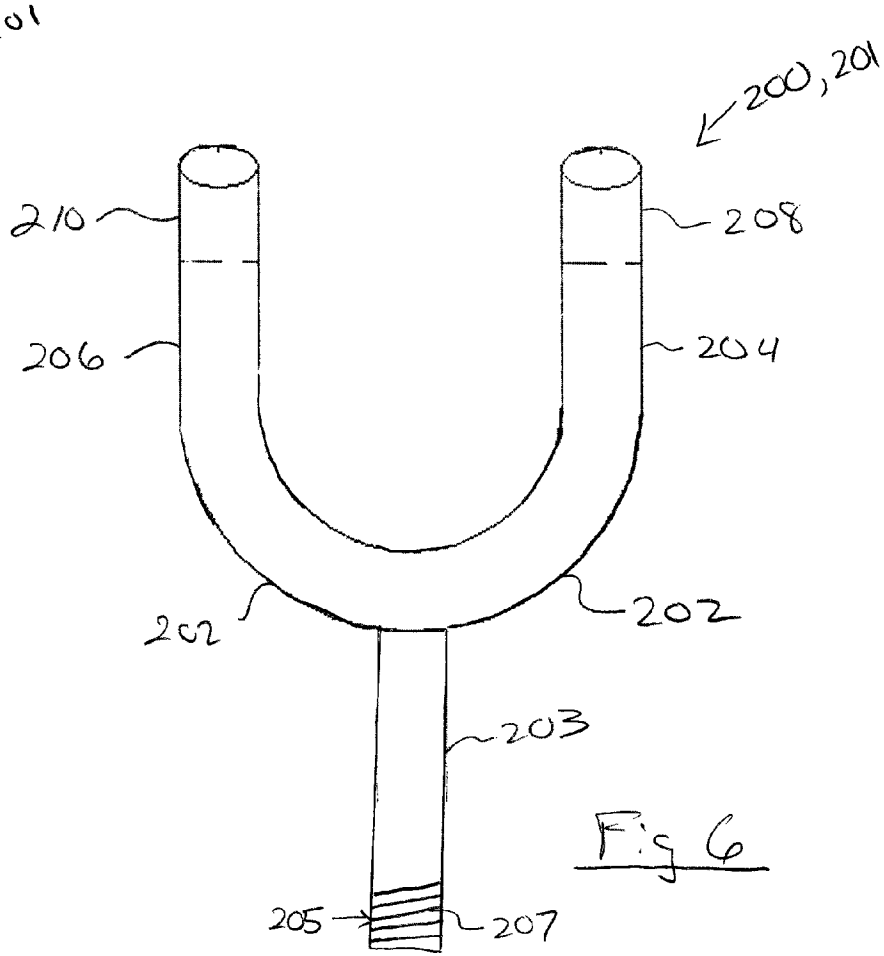
FIG. 6 is a front view of the skateboard binding of FIG. 1.
Figure 5:
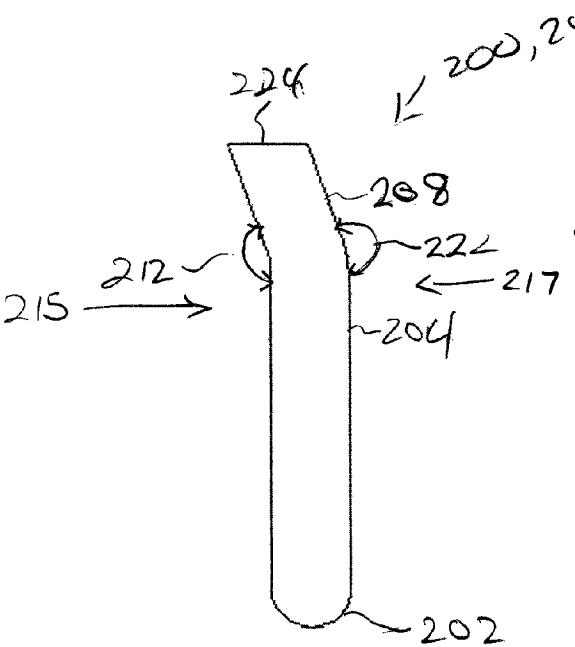
FIG. 5 is a partial side view of the skateboard binding of FIG. 1 with the support shaft not shown.

FIG. 6 shows a front view of the skateboard binding 200. FIG. 5 shows a partial side view of the skateboard binding 200 with a support shaft 203 not shown. The binding comprises the support shaft 203, and a first portion. In some embodiments the first portion is U-shaped as shown in the drawings. In other embodiments, the first portion may comprise any shape or formation that is configured to extend above the surface of a skateboard platform. The first portion has a curved bottom 202 jointing a first vertical portion 204 and a spaced apart second vertical portion 206. Each vertical portion comprises a retaining element 208, 210. Each of the retaining element and vertical portions 206 are mirror image identical about a mid-plane coincident with the support shaft 203. Each vertical portion comprises an inside face 215 and an outside face 217. A retaining angle 212 exists between the retaining element 208 and the adjacent vertical portion 204 on the inside face 215. In some embodiments, the retaining angle is one of an obtuse angle, a right angle, or an acute angle. The retaining angle 212 shown in the drawings is an obtuse angle. In some embodiments, the obtuse angle is one of the degrees between and including 130 degrees and 165 degrees. An outside angle 222 exists between the retaining element 208 and the adjacent vertical portion 204 on the outside face 217. In some embodiments, the outside angle 222 is such that the inside face is parallel to the outside face along the retaining element 208 and the vertical portion 204, respectively. The outside angle 222 is a reflex angle in the embodiment shown in the drawings.

Figure 4:
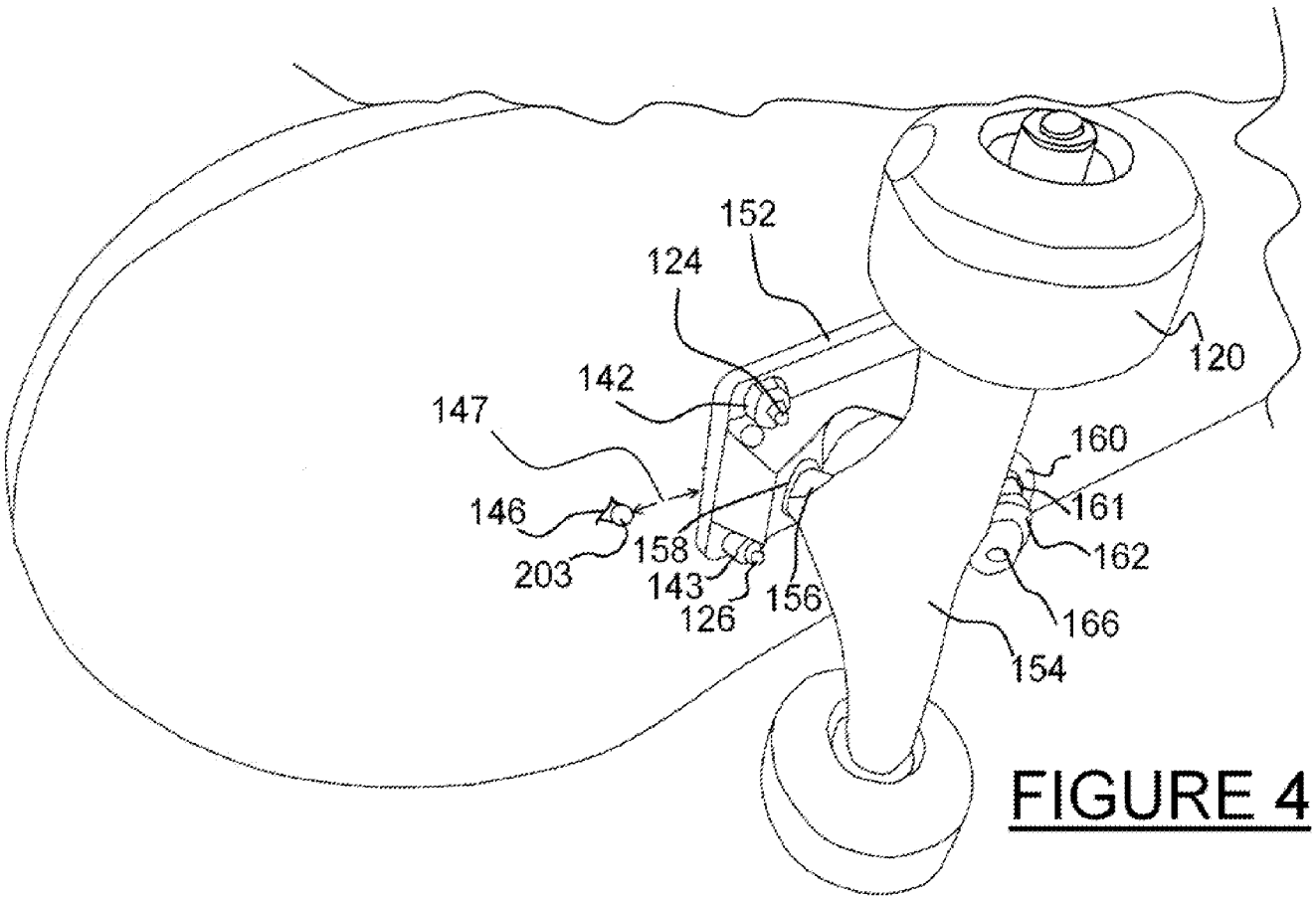
FIG. 4 is a perspective partial bottom view of the skateboard of FIG. 1.

To mount or install the bindings 200 to the platform 110, the shaft 203 of the binding 200 is placed in binding holes 146, 148 in the platform. The binding holes may be pre-drilled or may be drilled into a pre-existing skateboard platform to attach the bindings. The binding holes are located on the side of the wheel trucks opposite the longitudinal center 119. As shown in FIG. 4, the binding hole 146 is spaced a first gap distance 147 apart from the front of the base 152 of the wheel truck 150. In some embodiments, that first gap distance is between 0.5 inches and 1.25 inches and more preferably about 1 inch. A second gap distance (not marked) exists regarding binding 201 that is equal the first gap distance regarding binding 200. The location of the binding holes may be adjusted depending on the skateboard being used and the size and preference of the user.

As can be seen in FIG. 1, the placement of each of the bindings 200, 201 is immediately adjacent first foot placement areas 144, 145. While it is recognized that a user may place their feet in various locations on the platform, the first foot placement areas are where user's feet may be placed so that the user's feet are perpendicular or a least transverse to the longitudinal length of the board. In some embodiments, the first foot placement areas are located at least partially over the wheel trucks.

The shaft 203 of the bindings is placed into the binding holes until the bottom of the curved bottom 202 is adjacent or in contact with the upper surface of the platform. A washer may be placed around the shaft between the bottom of the curved bottom and the platform to buffer there between.

Figure 3:
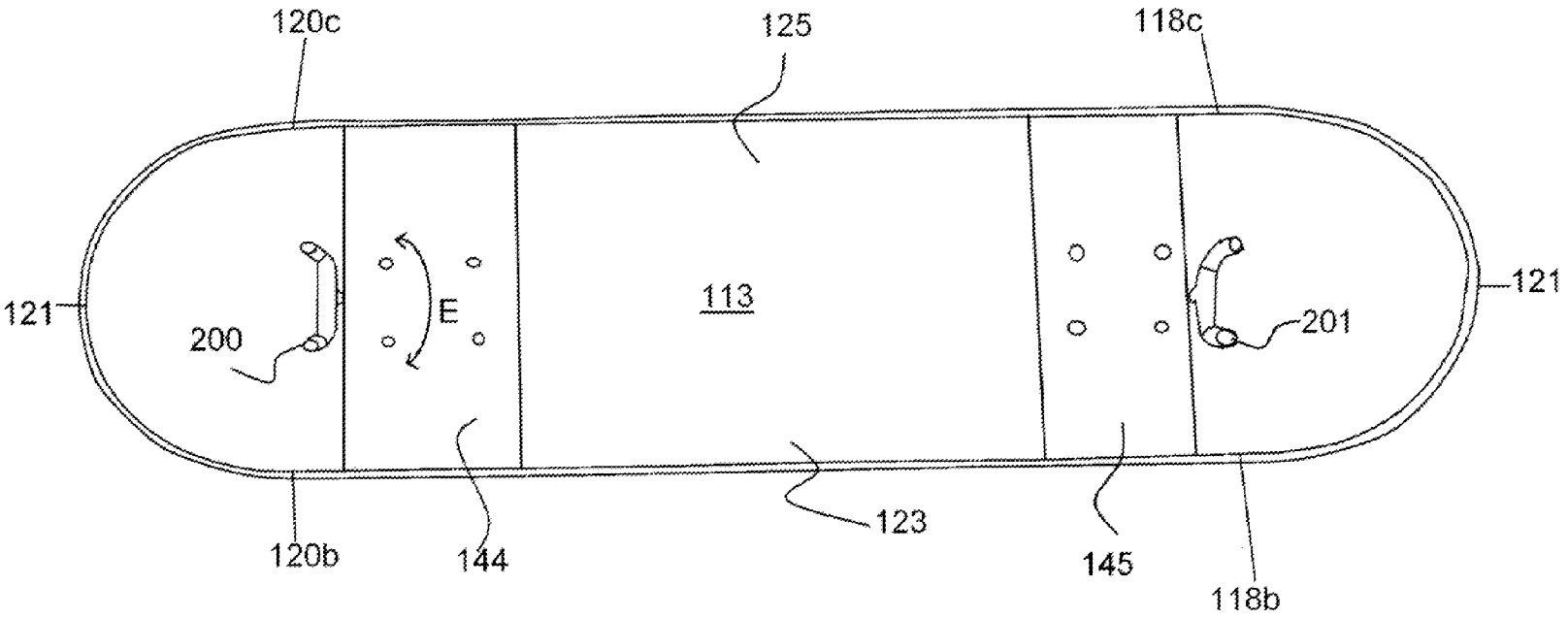
FIG. 3 is a top view of the skateboard taken from FIG. 1.

In some embodiments, the binding holes may comprise a threaded portion or may be completely threaded to receive a corresponding threaded portion 205 of the shaft 203 having threads 207. In some embodiments, the shaft 203 may extend through the platform and a fastener such as a nut is threaded to the shaft 203 and against the bottom surface 116 of the platform to secure the binding in place. Each binding may be pivotable about the shaft 203 at the binding hole, as shown by the arc E in FIG. 3.

In one aspect of usage, then the user places his or her feet on one or more of the first foot placement areas 144, 145, the user will place his or her foot so that the outside of the user's foot or shoe will be in contact with one or more of the binding 200, 201. The bindings allow the users to better and more easily control the skateboard with the user's feet than without the bindings. The retaining elements 208, 210 of the bindings allow the user to more easily lift the skateboard off the ground at one or both ends for performing stunts and tricks, such as when executing a jump. The user can direct the skateboard with the user's weight as directed through one or more of the users feet, and more specifically through the outside and upper portion of the users feet in contact with and along the curved bottom 202, one or more of the vertical portions 204, 206, and/or one or more of the retainer elements 208, 210 of the binding to effect the desired direction and manipulation of the skateboard. Therefore, when the rider jumps, the bindings will translate the upward movement of the rider to the skateboard and cause the skateboard to rise.

The pivotal nature of the bindings allows the binding to conform to the specific placement of the users foot adjacent the bindings for better control. The pivotal nature of the bindings allow the bindings to conform to the user's feet when the user's feet are transverse to the longitudinal length of the platform, but not exactly perpendicular to the longitudinal length. In some embodiments, a rotation stop element (not shown) is provided to limit the range of rotation of the binding. In some embodiment, the friction fit between the shaft and the binding hole or the platform top surface 114 is sufficient to limit the range of binding rotation. In some embodiments, the range of rotation of the binding is limited to one or more degrees between 10 degrees and 90 degrees in either direction from the home position where the vertical portions are perpendicular to the longitudinal midline 121 of the platform.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A skateboard with bindings, comprising:

a platform having a longitudinal length and a lateral width;

a pair of wheel trucks, spaced apart and attached to a bottom side of the platform;

two pairs of wheels, each wheel of each pair of wheels spaced apart from each other across at least a portion of the lateral width of the platform, one pair of wheels attached to each of the wheel trucks, the wheels are configured to support the platform on an external surface;

at least one binding comprising an engagement portion for receiving direction from a user's foot and a support shaft intersecting with and attached to the platform, the support shaft comprising a longitudinal length, the engagement portion extending above an upper side of the platform, the engagement portion pivotal about the longitudinal length of the support shaft to conform to a position of a user's foot.

2. The skateboard of claim 1, wherein the engagement portion is U-shaped; and the engagement portion is fixedly connected to the support shaft, the support shaft pivots in sync with the engagement portion about the longitudinal length of the support shaft.

3. The skateboard of claim 1, wherein the engagement portion comprises a retaining element.

4. The skateboard of claim 1, wherein the engagement portion comprises a first portion and a second portion and a retaining angle between the first and second portions, where the retaining angle is obtuse.

5. The skateboard of claim 1, wherein the engagement portion comprises a first portion and a second portion, where the first portion extends upward from the platform at a first angle and the second portion extends upward from the first portion at a retaining angle that is obtuse in relation to the first portion.

6. The skateboard of claim 1, wherein the engagement portion comprises a hook portion configured to engage at least a portion of an upper surface of a user's foot.

7. The skateboard of claim 1, wherein the at least one binding comprises two bindings, each binding located along the platform adjacent the wheel trucks on a side of the wheel trucks opposite a midpoint of the longitudinal length of the platform.

8. The skateboard of claim 1, wherein the at least one binding comprises two bindings, each binding positioned for contact with the outside of a user's foot when the user's foot is located above at least one of the wheel truck.

9. The skateboard of claim 1, wherein the at least one binding comprises two bindings, each binding located along the platform adjacent the wheel trucks on a side of the wheel trucks opposite a midpoint of the longitudinal length of the platform; and wherein the engagement portion comprises a first portion and a second portion and a retaining angle between the first and second portions, the retaining angle is obtuse.

10. The skateboard of claim 1, wherein the engagement portion is arched to receive direction from a user's foot through a user's shoe.

11. A binding for a skateboard, comprising:

a support shaft configured to intersect and attach to a skateboard platform, the support shaft having a longitudinal length;

an engagement portion for receiving contact with a user's foot, the engagement portion fixed to an end of the longitudinal length of the support shaft and extends longitudinally from the end of the longitudinal length of the support shaft, the engagement portion comprising two spaced apart upwardly extending arms, each arm comprising a first portion and a retaining portion and a first angle between the first portion and the retaining portion, the first angle is an angle other than a straight angle, the first angled portion configured to receive direction from an upper surface of a user's foot, the engagement portion pivotal about the longitudinal length of the support shaft.

12. The binding of claim 11, wherein the retaining portion positioned to receive contact from the top of a user's foot.

13. The binding of claim 11, wherein the first angle is an obtuse angle.

14. A binding for a skateboard, comprising:

a support member configured to intersect with and attach to a skateboard platform, the support member having a longitudinal length, the support member comprising a pivot axis extending along a longitudinal length of the support member;

an engagement portion for receiving contact with a user's foot, the engagement portion connected to an end of the longitudinal length of the support member and extending from the end of the longitudinal length of the support member, the engagement portion comprising at least one upwardly extending element configured to receive contact with a least apportion of the side of a user's foot to transfer force applied by the user to the skateboard platform; the engagement portion pivotal about the pivot axis of the support member to conform to a position of a user's foot.

15. The binding of claim 14, wherein the upwardly extending element comprises two spaced apart upwardly extending arms, each arm comprising a first portion and a retaining portion and a first angle between the first portion and the retaining portion, the first angle is obtuse.

16. The binding of claim 11, wherein the engagement portion is U-shaped; and the support shaft pivots in sync with the engagement portion about the longitudinal length of the support shaft.

17. A skateboard of claim 2, wherein the support shaft vertically penetrates the upper side of the platform; and the engagement portion comprises a first portion and a second portion, where the first portion extends upward from the platform at a first angle and the second portion extends upward from the first portion at a retaining angle that is obtuse in relation to the first portion.

* * * * *